US011060768B2

(12) United States Patent
Kelly

(10) Patent No.: US 11,060,768 B2
(45) Date of Patent: Jul. 13, 2021

(54) CRYOGENIC APPARATUS

(71) Applicant: ICEOXFORD LIMITED, Oxfordshire (GB)

(72) Inventor: Paul Kelly, Oxfordshire (GB)

(73) Assignee: Iceoxford Limited

( * ) Notice: Subject to any disclaimer, the term of this patent is extended or adjusted under 35 U.S.C. 154(b) by 55 days.

(21) Appl. No.: 15/764,854

(22) PCT Filed: Sep. 30, 2016

(86) PCT No.: PCT/GB2016/053049
§ 371 (c)(1),
(2) Date: Mar. 29, 2018

(87) PCT Pub. No.: WO2017/055865
PCT Pub. Date: Apr. 6, 2017

(65) Prior Publication Data

US 2019/0041103 A1 Feb. 7, 2019

(30) Foreign Application Priority Data

Oct. 1, 2015 (GB) ..... 1517391

(51) Int. Cl.
*F25B 9/10* (2006.01)
*F25B 9/14* (2006.01)
(Continued)

(52) U.S. Cl.
CPC ..... *F25B 9/10* (2013.01); *F25B 9/12* (2013.01); *F25B 9/14* (2013.01); *F25B 9/145* (2013.01); *F25D 19/006* (2013.01)

(58) Field of Classification Search
CPC ..... F25B 9/10; F25B 9/12; F25B 9/14; F25B 9/145; F25B 2309/02; F25B 2309/021;
(Continued)

(56) References Cited

U.S. PATENT DOCUMENTS 3,182,462 A * 5/1965 Long ..... F17C 3/085 62/45.1
3,221,509 A * 12/1965 Garwin ..... F25B 9/14 62/6

(Continued)

FOREIGN PATENT DOCUMENTS

EP 805317 11/1997

OTHER PUBLICATIONS

Search Report for Great Britain Application No. GB 1517391.7 dated Apr. 1, 2016.

(Continued)

*Primary Examiner* — Jianying C Atkisson
*Assistant Examiner* — Miguel A Diaz
(74) *Attorney, Agent, or Firm* — Tumey L.L.P.

(57) ABSTRACT

A cryogenic apparatus (10) comprises: an enclosure (12); a thermo-mechanical cooler (22) and a sample tube (20) that both project into the enclosure (12), where the sample tube (20) has a closed end; a pump (92) with a pump inlet and a pump outlet, and a duct to supply helium gas from the pump outlet to the thermo-mechanical cooler (22) to produce cold helium. The sample tube (20) has a first inlet (74) to allow a fluid into the sample tube (20), and a second inlet (83) to supply fluid to a thermal element (42) in thermal contact with the sample tube (20), and also has a first outlet (26) to withdraw fluid from within the sample tube (20), and a second outlet (28) to withdraw fluid from the thermal element (42). The apparatus also comprises a first duct including a first valve (80) to supply the cold helium to the first inlet (74) and a second duct including a second valve (82) to supply the cold helium to the second inlet (83); and either or both of the first outlet (26) and the second outlet (28) may be connected to the inlet of the pump (92). This enables a specimen to be cooled either in a static mode,
(Continued)

relying on natural convection, or in a dynamic mode, with a forced gas flow, or using both modes at once. These different options enable an operator to achieve different cooling rates.

10 Claims, 4 Drawing Sheets

(51) Int. Cl.
*F25B 9/12* (2006.01)
*F25D 19/00* (2006.01)

(58) Field of Classification Search
CPC ..... F25B 2309/1406; F25B 2309/1407; F25B 2309/1412; F25B 2309/1414; F25B 2309/1419; F25B 2309/1421; F25D 19/006; F25J 1/0276; F17C 3/085; F17C 13/006; Y10S 505/894
See application file for complete search history.

(56) References Cited

U.S. PATENT DOCUMENTS 5,647,228 A * 7/1997 Sager ..... B01L 7/00 62/49.2
5,970,804 A 10/1999 Robbat
6,202,439 B1 * 3/2001 Mikheev ..... F25B 9/12 62/51.1
7,157,999 B2 * 1/2007 Kasten ..... G01R 33/3815 324/318
7,183,769 B2 * 2/2007 Kasten ..... G01R 33/3815 324/318
7,492,154 B2 * 2/2009 Lucas ..... G01R 33/282 324/300
7,639,007 B2 * 12/2009 Hutton ..... G01R 33/30 324/307
8,683,816 B2 * 4/2014 Krencker ..... F28D 7/024 62/51.1
8,975,896 B2 * 3/2015 Schett ..... G01R 33/3403 324/318
9,234,691 B2 * 1/2016 Black ..... F17C 13/007
9,279,868 B2 * 3/2016 Lohman ..... G01R 33/282
2006/0096301 A1 * 5/2006 Triebe ..... F25D 19/006 62/6
2008/0264071 A1 * 10/2008 Saito ..... F25B 9/145 62/6
2008/0290869 A1 * 11/2008 Hutton ..... G01R 33/30 324/318
2009/0183860 A1 * 7/2009 Krencker ..... G01R 33/31 165/164
2011/0219785 A1 9/2011 Black et al.
2014/0202174 A1 * 7/2014 Wang ..... F25B 9/14 62/6
2014/0212174 A1 7/2014 Hayashi
2016/0061493 A1 * 3/2016 Morie ..... F25B 41/04 62/3.1
2017/0038123 A1 * 2/2017 Strickland ..... F25D 19/00
2018/0030593 A1 * 2/2018 Policandriotes ..... C23C 16/045
2018/0320936 A1 * 11/2018 Regnat ..... G01N 1/42
2019/0011170 A1 * 1/2019 Morie ..... F25B 9/002
2019/0041103 A1 * 2/2019 Kelly ..... F25B 9/145
2020/0018524 A1 * 1/2020 Graf ..... F25B 9/10

OTHER PUBLICATIONS

International Search Report for PCT Application No. PCT/GB2016/053049 dated May 4, 2017.
Written Opinion for PCT Application No. PCT/GB2016/053049 dated May 4, 2017.

* cited by examiner

CRYOGENIC APPARATUS

The present invention relates to a cryogenic apparatus, that is to say an apparatus for low-temperature refrigeration. Such apparatus may enable a specimen to be cooled to a temperature below 10 K, so measurements may be made on the properties of the specimen at such a cold temperature.

A number of different thermo-mechanical devices are known for achieving such low temperatures, for example using pressure cycling of helium gas. For example this may be achieved using a Stirling cooler, a Gifford-McMahon cooler, a pulse tube refrigerator, or a Joule-Thomson cooler. In the case of the Gifford-McMahon cooler, high-pressure helium at a pressure typically between 10 and 30 bar is used as the working fluid, and a cylinder contains a displacer and regenerator. A mechanical valve connects the cylinder to the gas at low pressure and high pressure alternately, and the displacer is moved in synchronisation with the operation of the valve. Gas expansion takes in heat from the environment at one end of the cylinder, so one end of the cylinder may be referred to as a cold head, and is cooled to a low-temperature. However, it is not always convenient to place the specimen directly in contact with the cold head of a thermo-mechanical cooler.

According to the present invention there is provided a cryogenic apparatus, the apparatus comprising: an enclosure; a thermo-mechanical cooler which projects into the enclosure; a sample tube that also projects into the enclosure, with a closed end within the enclosure; a pump having a pump inlet and a pump outlet, and a duct to supply helium gas from the pump outlet into thermal contact with the thermo-mechanical cooler to produce cold helium; wherein the sample tube is provided with a first inlet to allow a fluid into the sample tube in the vicinity of a specimen, and a second inlet to supply fluid to a thermal element in thermal contact with the sample tube in the vicinity of the specimen, and is provided with a first outlet to withdraw fluid from within the sample tube, and is provided with a second outlet to withdraw fluid from the thermal element; wherein the apparatus also comprises a first duct including a first valve to supply the cold helium to the first inlet, and a second duct including a second valve to supply the cold helium to the second inlet; and wherein both the first outlet and the second outlet may be connected to the pump inlet.

The first valve and the second valve may be needle valves, and may be controlled by control rods that extend into the enclosure. The enclosure may be evacuated in use to suppress heat transfer by convection. The thermo-mechanical cooler may be a two-stage cooler, with a first stage that achieves an intermediate cold temperature for example between 40 K and 100 K, for example about 50 K or 60 K. The apparatus may also include a heat shield at the intermediate temperature, the heat shield being in thermal contact with the thermo-mechanical cooler at a position having the intermediate temperature, and enclosing both the sample tube and the second stage of the thermo-mechanical cooler.

The first inlet may comprise a heat exchanger, for example a block of a good thermal conductor such as copper or aluminium, and defining a flow channel for the cold helium. The heat exchanger may also be provided with an electrical heater, so that the temperature of the helium that enters the sample tube from the first inlet is at a predetermined temperature. The first inlet may be below the specimen within the sample tube.

The thermal element to which the second inlet supplies helium may be a heat exchange sleeve which surrounds and is in contact with a portion of the sample tube and so ensures that that portion of the sample tube is in good thermal contact with the heat exchange sleeve. In a modification, the heat exchange sleeve may itself form a section of the sample tube. The thermal element may be above the specimen within the sample tube.

In operation a specimen is attached to one end of a specimen support rod, which is inserted into the sample tube; the specimen support rod may have any suitable cross-section shape, and may be tubular. Any air in the sample tube would then be extracted by a pump. The apparatus can then operate in two different modes. In a first mode, which may be referred to as a dynamic mode, the first valve is actuated so that cold helium is supplied to the first inlet, and helium is extracted through the first outlet. The specimen is therefore exposed to cold helium, which may be at a temperature below 10 K, more typically below 5 K, for example 1.5 K, 3 K or 4 K, and is cooled by contact with the cold helium. In a second mode, which may be referred to as a static mode, the second valve is actuated so that cold helium is supplied to the second inlet, and helium is extracted through the second outlet, so ensuring that the thermal element and the adjacent part of the sample tube is cooled by direct contact with the cold helium. This would normally be performed after evacuating the sample tube, and then introducing a small quantity of helium gas, so the helium gas within the sample tube is at low pressure, and in this case heat transfer would be by natural convection.

It will be appreciated that the sample tube, at the end outside the enclosure, must be provided with a closure so that the sample tube can be evacuated. That end of the sample tube may be provided with a vacuum gate, so a specimen can be introduced. However, in a preferred embodiment the sample tube is provided with a gas curtain through which helium gas is introduced wherever the sample tube is opened for inserting or removing a specimen, the gas curtain ensuring outflow of helium gas from the sample tube and so preventing air from flowing into the sample tube. The gas curtain may be provided by a gas header around the sample tube that communicates with inlet slots through the wall of the sample tube, helium gas being provided to the gas header.

The thermo-mechanical cooler in most cases will produce some vibration, and it is often desirable if vibration of the specimen is inhibited. For this reason the thermo-mechanical cooler may be mechanically linked to the remainder of the apparatus by a vibration-suppressing linkage such as a bellows. This may for example be an edge-welded bellows, of a material such as stainless steel, or bellows of a flexible plastic material.

The invention will now be further and more particularly described, by way of example only, and with reference to the accompanying drawings in which.

Figure 1:
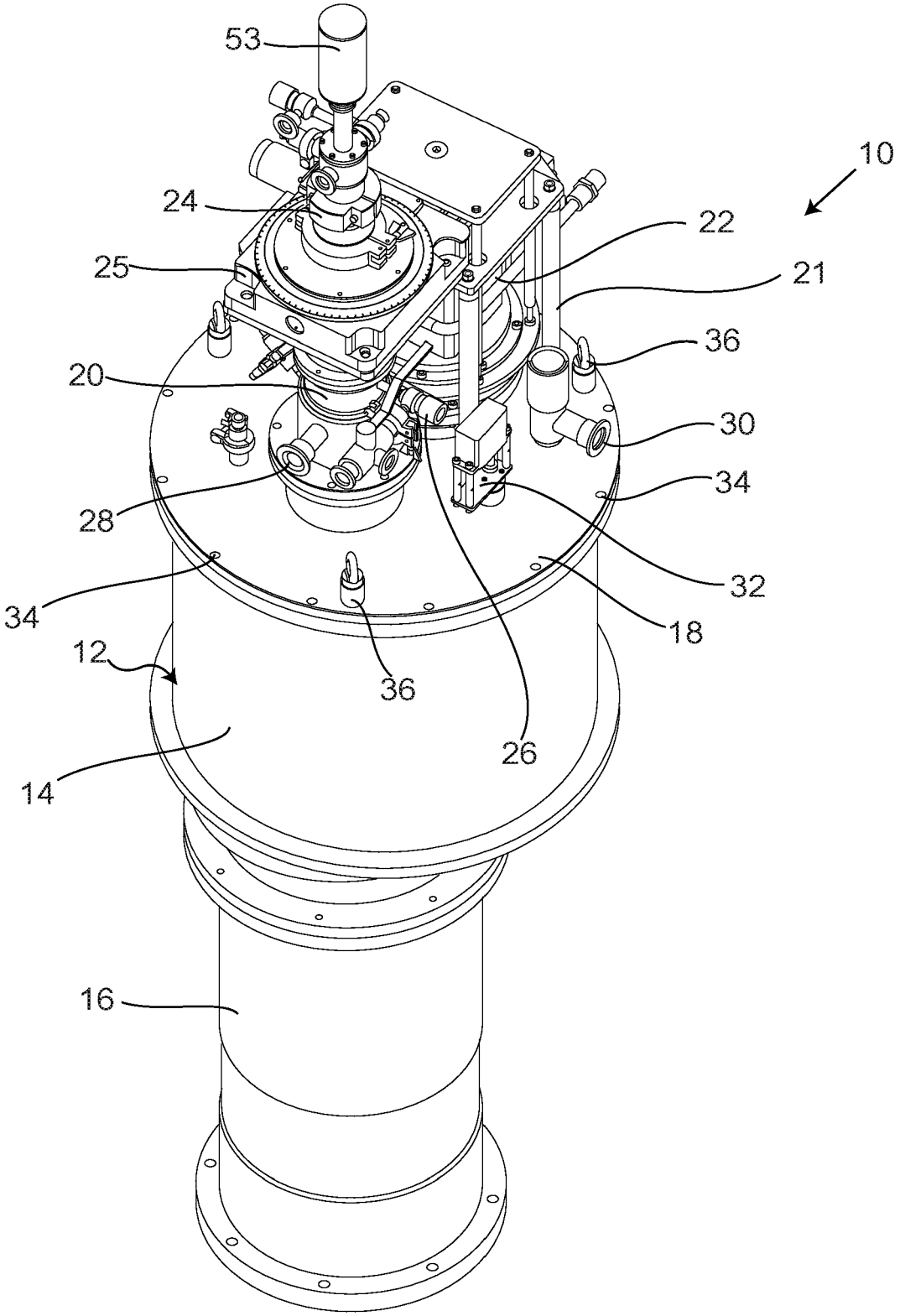
FIG. 1 shows a perspective view of a cryogenic apparatus of the invention, the apparatus including an enclosure with a top plate.

Referring to FIG. 1, a cryogenic apparatus 10 comprises an enclosure 12 that defines an upper cylindrical portion 14 and a lower cylindrical portion 16 of smaller diameter, and which is closed at the top by a top plate 18. Mounted on the top plate 18 are a sample tube 20 and a support frame 21 that supports a thermo-mechanical cooler 22. The sample tube 20 extends to near the bottom of the lower cylindrical portion 16 of the enclosure 12. The portion of the sample tube 20 above the top plate 18 is provided with a closure 24, a rotatable support 25 (so a specimen can be turned to a desired orientation), and first and second outlet ports 26 and 28.

The top plate 18 is also provided with a port 30 so the enclosure 12 can be evacuated. Also mounted on the top plate 18 are two needle valve drives 32 (only one is shown in FIG. 1). The top plate 18 is connected to the upper cylindrical portion 14 by bolts 34, and is also provided with three eye bolts 36 to facilitate lifting of the top plate 18 with the components that are mounted on it.

Figure 2:
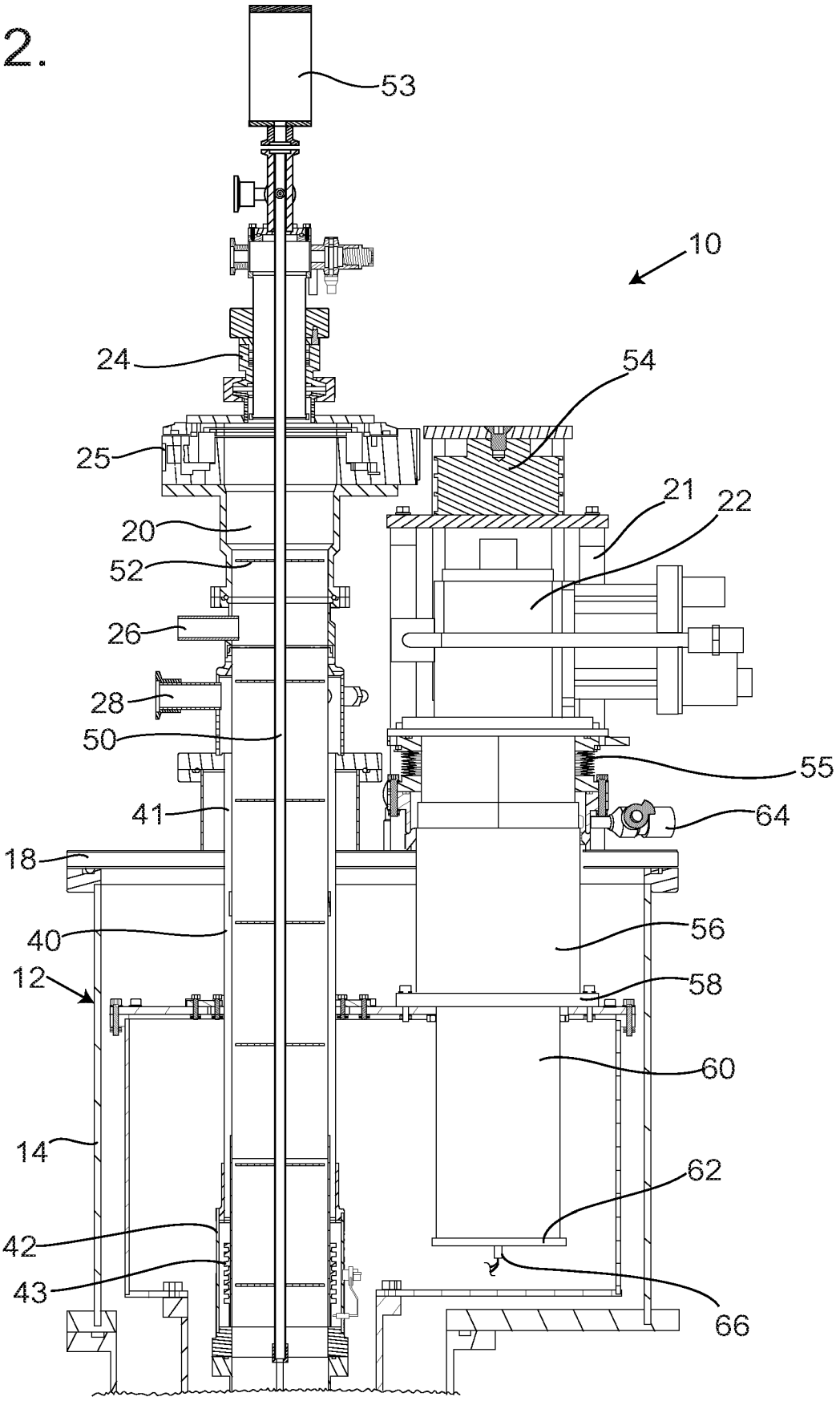
FIG. 2 shows an upper part of a longitudinal sectional view of the apparatus of FIG. 1, showing the apparatus above the top plate and part of the apparatus below the top plate.

Referring now to FIG. 2, this shows a longitudinal sectional view through the upper part of the cryogenic apparatus 10, showing components mounted on the top plate 18 and those within the upper cylindrical portion 14 of the enclosure 12.

Considering first the sample tube 20, the first port 26 (shown schematically) communicates with the space within the sample tube 20; the portion of the sample tube 20 below the first port 26 and within the upper cylindrical portion 14 is double-walled, the sample tube 20 being surrounded by a concentric tube 40 so as to define an annular space 41, and the second port 28 communicates with this annular space 41. The annular space 41 at its lower end is defined by a double walled heat exchanger 42 which has a slightly larger external diameter than the tube 40; the inner wall of the heat exchanger 42 is of copper and defines several ribs 43 that project radially outwards into the annular space 41. The inner wall of the heat exchanger 42 defines part of the sample tube 20; the annular space 41 is closed at the bottom of the heat exchanger 42 and the portion of the sample tube 20 that continues below the heat exchanger 42 is single walled.

A specimen support rod 50 extends through the sample tube 20, and there are several circular baffles 52 mounted on the support rod 50 spaced apart along its length, to inhibit heat transfer by radiation along the sample tube 20. In this example the specimen support rod 50 consists of a first thin-walled stainless steel tube that in use extends to just below the bottom of the heat exchanger 42, whose bore contains helium and is connected to a vessel 53; and a second thin-walled stainless steel tube extending from below the bottom of the heat exchanger 42 to the specimen-support block 72, with holes (not shown) through its wall near both ends. In each case the thin wall, and the use of stainless steel, suppress heat transfer by conduction. Connecting the bore of the tube to the vessel 53 provides a gas buffer to prevent gaseous oscillations within the tube.

The thermo-mechanical cooler 22 in this embodiment is a two-stage Gifford-McMahon (GM) cooler which uses high-pressure helium at a pressure typically between 10 bar and 30 bar as the working fluid, in a closed circuit. The working fluid is provided by an external compressor (not shown). Each stage of the GM cooler includes a cylinder with a movable displacer and a rotary valve to connect the cylinder alternately to high pressure and low pressure; and the GM cooler also includes a mechanism to move the displacers in synchronisation with the movement of the valve. This is a commercially-available product (e.g. from Sumitomo Heavy Industries) and its details are not the subject of the present invention. Since the thermo-mechanical cooler 22 includes moving parts, which operate typically at a frequency of about 1 Hz, the components that are subject to this oscillation are separated from the items connected to the top plate 18, firstly by connecting the thermo-mechanical cooler 22 to the support frame 21 by a vibration-suppressing rubber mount 54, and also by the provision of a vibration-suppressing stainless steel edge-welded bellows 55.

Each stage of the thermo-mechanical cooler 22 is enclosed within a stainless steel sleeve: the first stage is enclosed within a sleeve 56 which extends from above the top plate 18, and at its lower end is connected to a thermal plate 58 of copper; while the second stage, which is of smaller diameter, is enclosed within a stainless steel sleeve 60, and at its lower end terminates at a thermal plate 62 of copper. During operation of the thermo-mechanical cooler, the temperature of the thermal plate 58 is typically lowered to an intermediate low-temperature of about 50 K, while the temperature of the thermal plate 62 is lowered to about 4 K or below.

An inlet port 64 just above the top plate 18 allows helium gas, typically at a low pressure of about 200 mbar, to be fed into the sleeve 56 so it is cooled successively by the two stages of the GM cooler. There is a fluid outlet 66 through the thermal plate 62, through which liquid or gaseous helium would therefore emerge during operation. This is described in more detail below in relation to FIG. 4.

Figure 3:
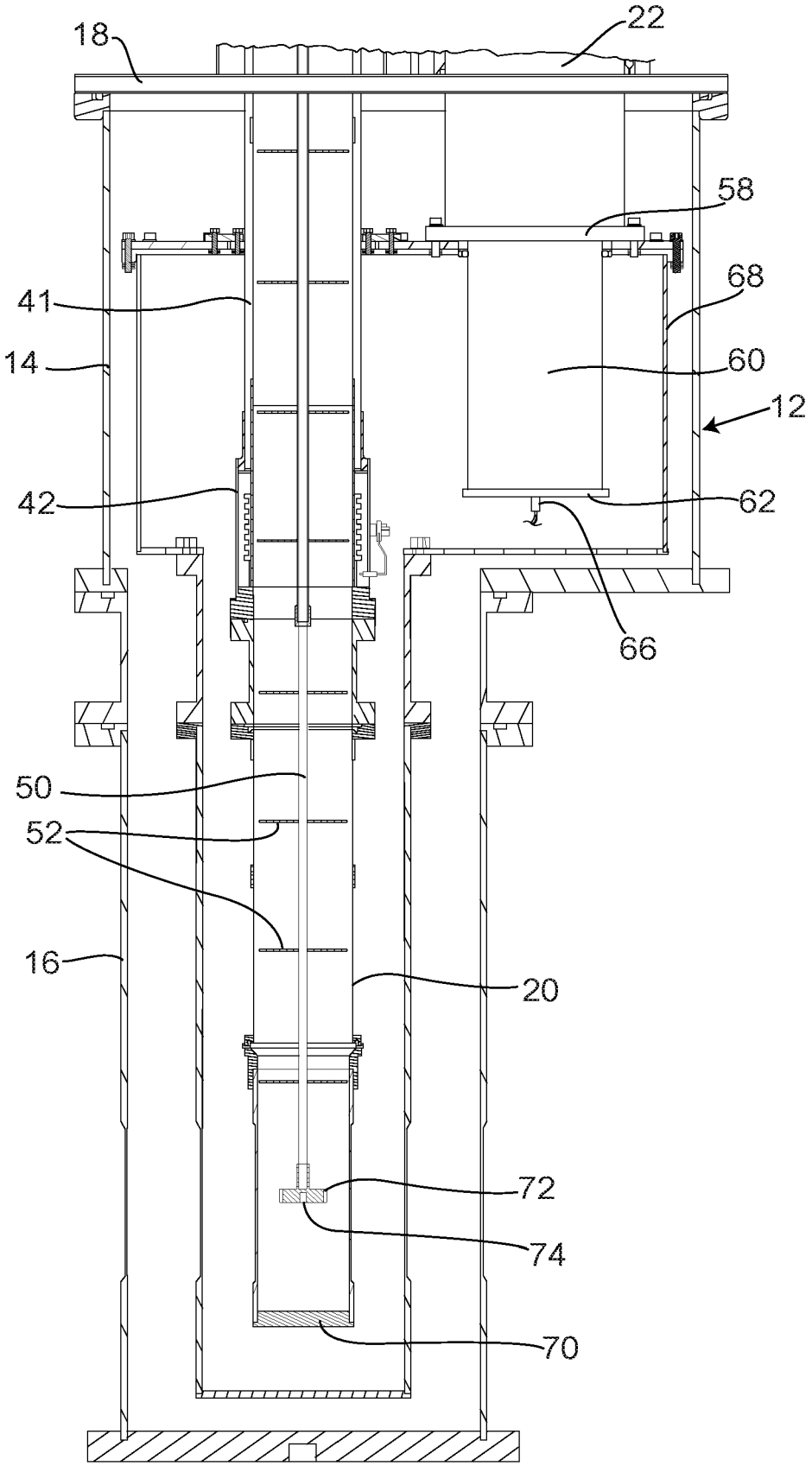
FIG. 3 shows a lower part of the same longitudinal sectional view shown in FIG. 2, FIG. 3 showing the apparatus below the top plate.

As shown also in FIG. 3, to which reference is also made, the thermal plate 58 is connected to a thin sheet aluminium thermal shield 68, which encloses the sleeve 60 that surrounds the second stage of the GM cooler and also encloses the lower part of the sample tube 20. The thermal shield 68 is also connected to the sample tube 20 at the level of the thermal plate 58, which is above the heat exchanger 42. The thermal shield 68 is provided with apertures (not shown) so that the space within the thermal shield 68 is evacuated when the remainder of the enclosure 12 is evacuated.

As shown in FIG. 3, the sample tube 20 is closed at its lower end by a copper heat exchange block 70. The specimen support rod 50 is connected at its lower end to a copper specimen-support block 72 onto which a specimen (not shown) can be mounted by means of a blind threaded recess 74. In this example it is intended that the specimen may be exposed to radiation when it is at a cold temperature, and for this reason the portions of the walls of the lower cylindrical portion 16 of the enclosure and of the thermal shield 68 the vicinity of the specimen-support block 72 are thinner than the other parts of those components.

Figure 4:
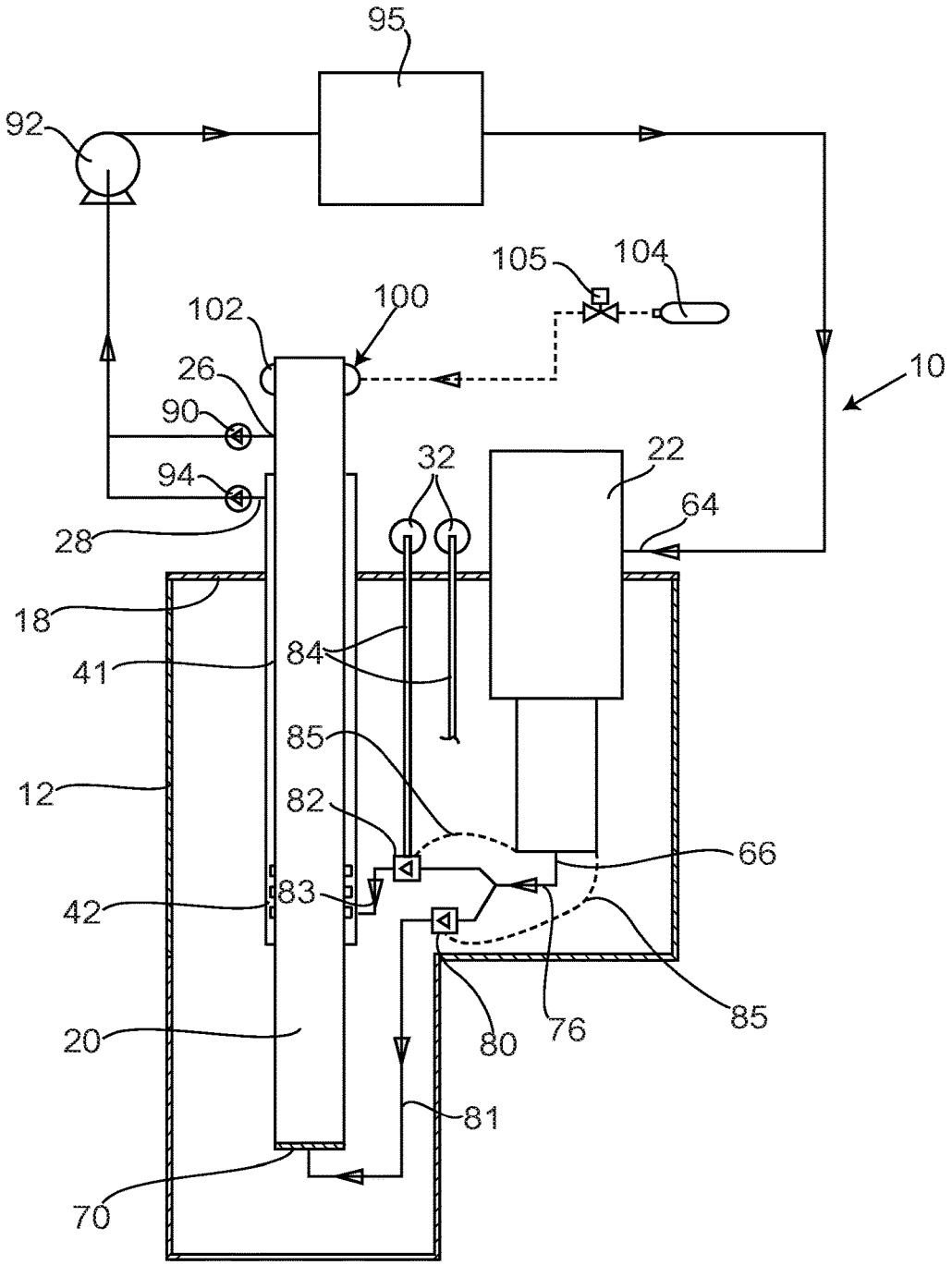
FIG. 4 shows a partly schematic view of the cryogenic apparatus of FIG. 1, in particular showing a fluid flow path.

Referring now to FIG. 4, this shows the cryogenic apparatus 10 somewhat schematically; for example it does not show the thermal shield 68, nor does it show the specimen support rod 50. The fluid outlet 66 through the thermal plate 62, at the bottom of the second stage of the thermo-mechanical cooler 22, communicates through a capillary tube 76 which branches into two. Each branch of the capillary tube 76 leads to a needle valve: a first needle valve 80 communicates through a capillary tube 81 to the heat exchange block 70 at the bottom of the sample tube 20, while a second needle valve 82 communicates through a capillary tube 83 to the heat exchanger 42. Each needle valve 80 and 82 is controlled by a respective drive rod 84 (one of which is shown only in part, for clarity) which extends through the top plate 18 to the needle valve drives 32. To ensure the needle valves 80 and 82 remain cold, they are connected by copper braids 85 (represented by broken lines) to the thermal plate 62.

The heat exchange block 70 defines a flow channel through the block into the sample tube 20. The heat exchange block 70 may also be provided with an electrical heater, and a temperature sensor, so the temperature of the helium gas entering the sample tube 20 can be accurately controlled.

In a modification, the bottom end of the sample tube 20 may be closed by an impermeable end plate, and the heat exchange block 70 through which cold helium gas is fed into the sample tube 20 may instead be of annular form, forming part of the wall of the sample tube 20. The heat exchange block 70 should always be below the position of the heat exchanger 42. Arranging the heat exchange block 70 at a position above the position of the specimen-support block 72, but below the position of the heat exchanger 42, would be appropriate if the user does not wish there to be active gas flow over the specimen.

The first outlet port 26 communicates through a valve 90 to an inlet of a pump 92, while the second outlet port 28 communicates through a valve 94 to the inlet of the pump 92. The outlet of the pump 92 is connected to a gas reservoir 95, and an outlet from the gas reservoir 95 leads to the inlet port 64.

Thus in operation, the enclosure 12 is evacuated through the port 30. The thermo-mechanical cooler 22 is activated to cool the components within the enclosure 12. A specimen is mounted onto the specimen-support block 72 and the specimen-support rod 50 is inserted into the sample tube 20, the closure 24 is sealed and the orientation of the specimen set by means of the rotatable support 25. The sample tube 20 would also be evacuated, to remove any traces of air.

Cooling of the specimen is carried out by recirculating helium using the pump 92, and this may be carried out either in a dynamic mode or in a static mode. In each mode helium gas is provided to the inlet port 64, and is cooled to about 4 K in passing through the thermo-mechanical cooler 22, so typically it becomes liquefied. In the dynamic mode of operation the first needle valve 80 is opened and the second needle valve 82 is closed; the valve 90 associated with the first outlet port 26 is also open. Liquid helium flows through the first needle valve 80 and the capillary tube 81 and through the heat exchange block 70 into the sample tube 20 where it evaporates; cold gaseous helium flows over the surface of the specimen, flows up the sample tube 20 to emerge through the first outlet port 26. The pump 92 ensures helium is continuously removed from the sample tube 20, to be recirculated. This would typically involve a gas pressure within the sample tube 20 of up to 10 or 15 mbar, although this pressure can be adjusted by adjusting the flow rate through the pump 92, for example using a throttle valve. Although the liquid helium is at 4 K initially, the gas temperature in the sample tube 20 may be less than that because latent heat is required to vaporise the helium; the gas temperature and so the temperature of the specimen is therefore affected by the flow rate of gas through the sample tube 20 caused by the pump 92. For example a temperature of 1.5 K can be achieved.

In the static mode of operation the second needle valve 82 is opened and the first needle valve 80 is closed; the valve 94 associated with the second outlet port 28 is also open. Liquid helium flows through the second needle valve 82 and the capillary tube 83 into the heat exchanger 42, where it cools the wall of the sample tube 20. The resulting gaseous helium flows up the annular space 41 to emerge through the second outlet port 28, and the pump 92 ensures helium is continuously removed from the annular space 41 to be recirculated. In this mode of operation helium would also be introduced into the sample tube 20, so the pressure in the sample tube 20 is initially at for example between 200 and 800 mbar, for example between 400 and 600 mbar, when the gas is at ambient temperature; this helium gas is not recirculated. In this case the helium gas within the sample tube 20 would undergo natural convection, because the wall of the sample tube 20 in the heat exchanger 42 is being kept cold, and this natural convection lowers the temperature of the specimen. As the temperature of the gas within the sample tube 20 becomes lower, so does the gas pressure within the sample tube 20, and typically it would drop to about 10 mbar.

As another option, both the dynamic cooling mode and the static cooling mode may be performed simultaneously, by supplying the liquid helium through both the needle valves 80 and 82. An operator of the cryogenic apparatus 10 can therefore select from three different modes of operation—the static mode, the dynamic mode, and their combination—and so can achieve different rates of cooling of the specimen within the sample tube 20.

As a further option, the sample tube 20 may be provided with a gas curtain 100 below the closure 24. This feature is shown only in FIG. 4. The gas curtain 100 consists of an annular header 102 around the sample tube 20, and with apertures or slits through the wall of the sample tube 20. As indicated in broken lines, a supply of high-purity helium 104 may then be arranged to supply helium to the header 102 through a control valve 105 whenever the top end of the sample tube 20 is open for removing or inserting a specimen. This gas curtain 100 ensures there is a continuous flow of helium out of the open end of the sample tube 20, and so prevents air from entering the sample tube 20.

The provision of the facility for both dynamic cooling and static cooling of the specimen has been found to be advantageous, as dynamic cooling can achieve more rapid cooling of the specimen, whereas static cooling is desirable where the specimen is to be exposed to low gas pressures. For example when performing static cooling, having achieved a desired low-temperature of the specimen, the gas within the sample tube 20 may then be extracted immediately before making measurements (for example using a neutron beam), so that there is no helium within the sample tube 20 while measurements are being made.

So in some applications it is advantageous to operate initially with dynamic cooling, so that the specimen is cooled down as rapidly as possible by helium gas flowing through the sample tube 20. When the desired temperature is approached, the mode of operation may be changed to static cooling, leaving some helium within the sample tube 20, and supplying the liquid helium from the outlet 66 to the heat exchanger 42, so that further cooling takes place by natural convection within the sample tube 20.

As indicated above the cryogenic apparatus 10 enables the temperature of a specimen within the sample tube 20 to be cooled to a temperature such as 1.5 K. A lower temperature can be achieved by mounting a secondary cooling insert (not shown) within the sample tube 20 in the vicinity of the specimen-support block 72, this achieving further cooling by performing helium expansion in a separate circuit from that described above. Depending on the dimensions and the mode of operation, this can achieve a temperature as low as 300 mK, or 25 mK, or even 15 mK.

What is claimed:

1. A cryogenic apparatus, the apparatus comprising:

an enclosure;

a thermo-mechanical cooler which projects into the enclosure;

a sample tube that also projects into the enclosure, with a closed end within the enclosure;

a support rod having a specimen-support block at an end of the support rod to support a specimen within the sample tube;

a pump having a pump inlet and a pump outlet, and a duct to supply coolant gas from the pump outlet into thermal contact with the thermo-mechanical cooler to produce cold coolant;

wherein the sample tube is provided with:

a heat exchange sleeve which surrounds a portion of the sample tube and is in thermal contact with a portion of the wall of the sample tube, a first inlet to allow cold coolant into the sample tube, a second inlet to supply cold coolant to the heat exchange sleeve, a first outlet to withdraw coolant gas from within the sample tube, and a second outlet to withdraw coolant gas from the heat exchange sleeve;

wherein the apparatus also comprises:

a first duct including a first valve to supply the cold coolant from the thermo-mechanical cooler to the first inlet, and a second duct including a second valve to supply the cold coolant from the thermo-mechanical cooler to the second inlet; and wherein both the first outlet and the second outlet are connected to the pump inlet.

2. A cryogenic apparatus as claimed in claim 1 wherein a thermal element to which the second inlet supplies cold coolant is above a specimen position within the sample tube.

3. A cryogenic apparatus as claimed in claim 1 wherein the sample tube is provided with a gas curtain at an end of the tube adjacent to a closure element outside the enclosure.

4. A cryogenic apparatus as claimed in claim 1 wherein the thermo-mechanical cooler is mechanically linked to the remainder of the apparatus by a vibration-suppressing linkage.

5. A cryogenic apparatus as claimed in claim 1 wherein the first valve and the second valve are needle valves.

6. A cryogenic apparatus as claimed in claim 5 also comprising control rods that extend into the enclosure to actuate the valves.

7. A cryogenic apparatus as claimed in claim 1 wherein the thermo-mechanical cooler is a two-stage cooler, with a first stage that achieves an intermediate cold temperature, and a second stage that achieves a final cold temperature which is lower than the intermediate cold temperature.

8. A cryogenic apparatus as claimed in claim 7 also comprising a heat shield that is in thermal contact with the thermo-mechanical cooler at a position having the intermediate cold temperature, and that encloses both the sample tube and the second stage of the thermo-mechanical cooler.

9. A cryogenic apparatus as claimed in claim 1 wherein the first inlet comprises a heat exchanger that defines a flow channel for the cold coolant.

10. A cryogenic apparatus as claimed in claim 9 wherein the first inlet is below the specimen position within the sample tube.

* * * * *